US005517713A

United States Patent [19]

Hadcock

[11] Patent Number: 5,517,713

[45] Date of Patent: May 21, 1996

[54] SURE-GRIP TOOTHBRUSH

[76] Inventor: Jay C. Hadcock, 1773 Lakeview St., Trenton, Mich. 48183

[21] Appl. No.: 440,486

[22] Filed: May 12, 1995

[51] Int. Cl.[6] ..... A64B 9/04

[52] U.S. Cl. ..... 15/167.1; 15/143.1; D4/104; D4/138

[58] Field of Search ..... 15/143.1, 167.1; D4/104, 138

[56] References Cited

U.S. PATENT DOCUMENTS

| | | | |
|---|---|---|---|
| D. 109,472 | 5/1938 | Clarren | D4/104 |
| 1,476,579 | 12/1923 | Barnes | 15/167.1 |
| 1,758,632 | 5/1930 | Wagner | 15/167.1 |
| 2,668,308 | 2/1954 | Grossman | 15/143.1 |
| 4,051,571 | 10/1977 | Ayers | 15/167.1 |
| 4,457,039 | 7/1984 | Massari | 15/167.1 |
| 4,704,758 | 11/1987 | Hoffman | 15/143.1 |
| 4,809,388 | 3/1989 | Dietrich | 15/143.1 |

FOREIGN PATENT DOCUMENTS

| | | | |
|---|---|---|---|
| 292523 | 12/1935 | Italy | 15/143.1 |

*Primary Examiner*—Mark Spisich

[57] ABSTRACT

A toothbrush including a handle having an upper surface, a lower surface, a proximal end and a distal end with a head portion having a plurality of bristle tufts integral thereto and an intermediate portion therebetween. An L-shaped portion having a horizontal extent and a vertical extent being formed integral with the horizontal extent and the proximal end of the handle. A gripping portion being formed along the intermediate portion of the handle on the upper surface and capable of supporting a thumb of a hand. A distal widened V-shaped portion having a pair of extents with a distal seat therebetween, each extent having a second end integral with the distal end and a first end integral with the gripping portion to form a proximal widened V-shaped portion with a proximal seat, the extent between the distal seat and the proximal seat being capable of supporting an index finger of the hand while the intermediate portion rest in the palm of the hand.

1 Claim, 3 Drawing Sheets

FIG 3
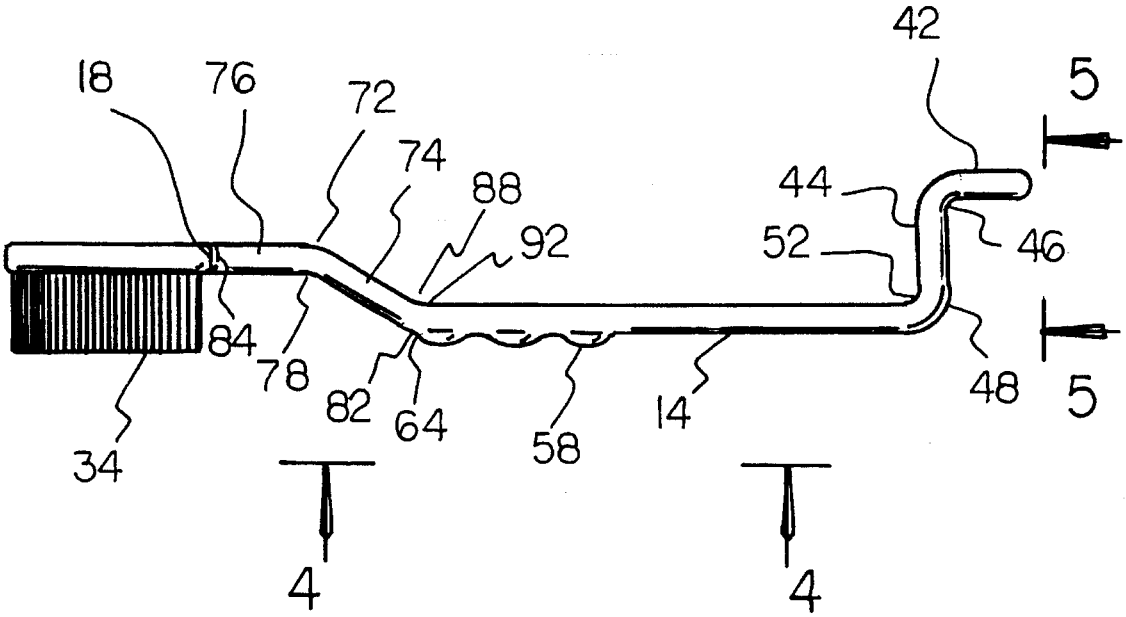
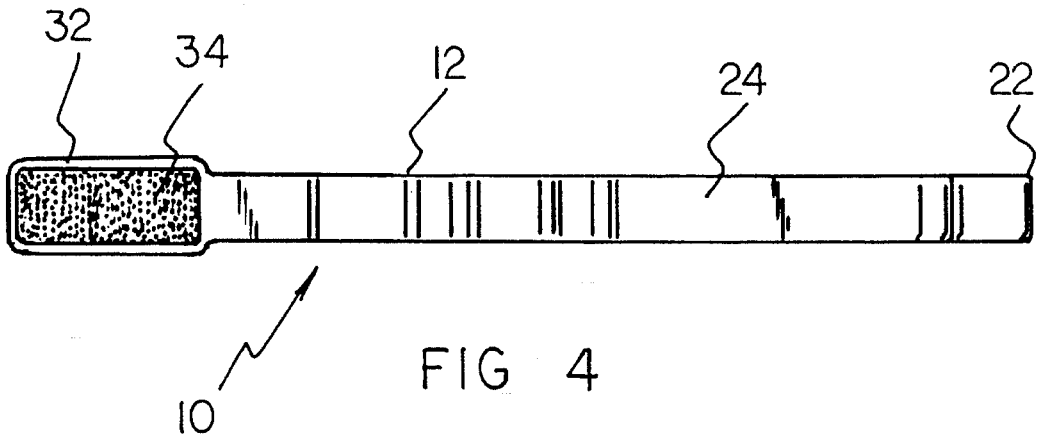
FIG 4

SURE-GRIP TOOTHBRUSH

BACKGROUND OF THE INVENTION

1. Field of the Invention

The present invention relates to a sure-grip toothbrush and more particularly pertains to allowing a user to be able to hold a toothbrush handle in the palm of the hand, instead of between the fingers, when in use and further preventing twisting of the handle in the hand when the toothbrush is being used.

2. Description of the Prior Art

The use of toothbrushes is known in the prior art. More specifically, toothbrushes heretofore devised and utilized for the purpose of cleaning teeth are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,457,039 to Massari discloses a toothbrush with anatomically designed handle. U.S. Pat. No. 4,109,339 to Dietrich discloses a toothbrush with a curved handle. U.S. Pat. No. Des. 347,736 to Schneider and Greubel discloses a toothbrush handle. U.S. Pat. No. Des. 347,524 to Simone, Sherman, Mintel and McKinney discloses a toothbrush handle. U.S. Pat. No. 5,339,482 to Desimone and Goldinger discloses a toothbrush having a non-slip surface. Lastly, U.S. Pat. No. 5,191,671 to Rudnick discloses a toothbrush handle.

While these devices fulfill their respective, particular objectives and requirements, the aforementioned patents do not describe a sure-grip toothbrush that is easily held in the palm of the and has a double L-shaped member, a double widened V-shaped member and a gripping portion to support the fingers and disallow twisting of the handle in the hand.

In this respect, the sure-grip toothbrush according to the present invention substantially departs from the conventional concepts and designs of the prior art, and in doing so provides an apparatus primarily developed for the purpose of allowing a user to be able to hold a toothbrush handle in the palm of the hand, instead of between the fingers, when in use and further preventing twisting of the handle in the hand when the toothbrush is being used.

Therefore, it can be appreciated that there exists a continuing need for a new and improved sure-grip toothbrush which can be used for allowing a user to be able to hold a toothbrush handle in the palm of the hand, instead of between the fingers, when in use and further preventing twisting of the handle in the hand when the toothbrush is being used. In this regard, the present invention substantially fulfills this need.

SUMMARY OF THE INVENTION

In view of the foregoing disadvantages inherent in the known types of toothbrushes now present in the prior art, the present invention provides an improved sure-grip toothbrush. As such, the general purpose of the present invention, which will be described subsequently in greater detail, is to provide a new and improved sure-grip toothbrush and method which has all the advantages of the prior art and none of the disadvantages.

To attain this, the present invention essentially comprises, in combination a handle formed of a rigid material having an upper surface, a lower surface, a distal end, a proximal end and an intermediate portion therebetween. The distal end has a generally rectangular head portion that is adjacent and integral thereto. The head has an upper surface with a plurality of bristle tufts extending therefrom. The bristle tufts have a uniform height. An L-shaped portion having a horizontal extent in a plane parallel with the handle and a vertical extent is included. The vertical extent is formed integral with the horizontal extent at a first end and integral with the proximal end of the handle at a second end. The L-shaped portion being integral to the proximal end creates a bend at the proximal end of the handle to form a double L-shaped member on the handle. A gripping portion is included. The gripping portion has a first end and a second end being formed on the intermediate portion of the handle along the upper surface. The first end is spaced from the proximal end. The gripping portion is integral with the handle and capable of receipt of a thumb of a hand. Lastly, a distal widened V-shaped portion having a pair of extents with a distal seat therebetween is included. Each extent has a second extent with a second end integral with the distal end of the handle, and a first extent with a first end integral with the second end of the gripping portion. The first end of the V-shaped portion and the second end of the gripping portion form a proximal widened V-shaped portion having a proximal seat integral with the second end of the gripping portion. The distal V-shaped portion and the proximal V-shaped portion form a double V-shaped member spaced from the distal end of the handle. The double V-shaped member allows an index finger to rest thereon while the lower surface of the handle, along the intermediate portion, rest in the palm of the hand and a smallest finger rest on the vertical extent of the double L-shaped member. The hand being positioned along the handle in the above manner prevents twisting of the handle in the hand.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sure-grip toothbrush which has all of the advantages of the prior art toothbrushes and none of the disadvantages.

It is another object of the present invention to provide a new and improved sure-grip toothbrush which may be easily and efficiently manufactured and marketed.

It is further object of the present invention to provide a new and improved sure-grip toothbrush which is of durable and reliable constructions.

An even further object of the present invention is to provide a new and improved sure-grip toothbrush which is susceptible of a low cost of manufacture with regard to both materials and labor, and which accordingly is then susceptible of low prices of sale to the consuming public, thereby making such sure-grip toothbrush economically available to the buying public.

Still yet another object of the present invention is to provide a new and improved sure-grip toothbrush which provides in the apparatuses and methods of the prior art some of the advantages thereof, while simultaneously overcoming some of the disadvantages normally associated therewith.

Even still another object of the present invention is to provide a new and improved toothbrush for allowing a user to be able to hold a toothbrush handle in the palm of the hand, instead of between the fingers, when in use and further preventing twisting of the handle in the hand when the toothbrush is being used.

Lastly, it is an object of the present invention to provide a new and improved toothbrush comprising a handle having an upper surface, a lower surface, a proximal end and a distal end with a head portion having a plurality of bristle tufts integral thereto and an intermediate portion therebetween. An L-shaped portion has a horizontal extent and a vertical extent being formed integral with the horizontal extent and the proximal end of the handle. A gripping portion is formed along the intermediate portion of the handle on the upper surface and capable of supporting a thumb of a hand. A distal widened V-shaped portion has a pair of extents with a distal seat therebetween. Each extent has a second end integral with the distal end and a first end integral with the gripping portion to form a proximal widened V-shaped portion with a proximal seat. The extent is between the distal seat and the proximal seat being capable of supporting an index finger of the hand while the intermediate portion rest in the palm of the hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the present invention.

FIG. 4 is a top plan view of the present invention along lines 4—4 of FIG. 3.

The same reference numerals refer to the same parts through the various Figures.

DESCRIPTION OF THE PREFERRED EMBODIMENT

Figure 1:
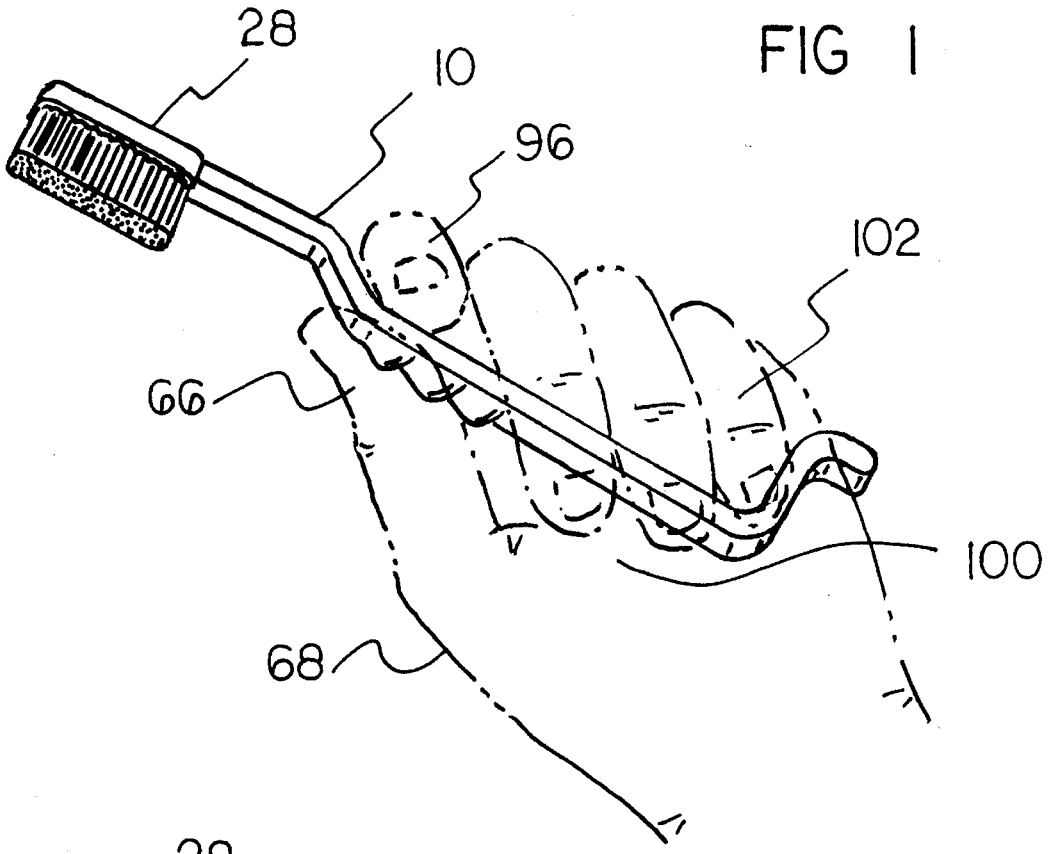
FIG. 1 is a perspective view of the preferred embodiment of the sure-grip toothbrush constructed in accordance with the principles of the present invention.

With reference now to the drawings, and in particular to FIG. 1 thereof, the preferred embodiment of the new and improved sure-grip toothbrush embodying the principles and concepts of the present invention and generally designated by the reference numeral 10 will be described.

The present invention, the sure-grip toothbrush 10 is comprised of a plurality of components. Such components in their broadest context include a handle, an L-shaped portion, a gripping portion, a V-shaped portion. Such components are individually configured and correlated with respect to each other so as to attain the desired objective.

Specifically, the present invention includes a handle 12 formed of a rigid material such as plastic. The handle has an upper surface 14, a lower surface 16, a distal end 18, a proximal end 22 and an elongated intermediate portion 24 therebetween as shown in FIG. 2.

Figure 2:
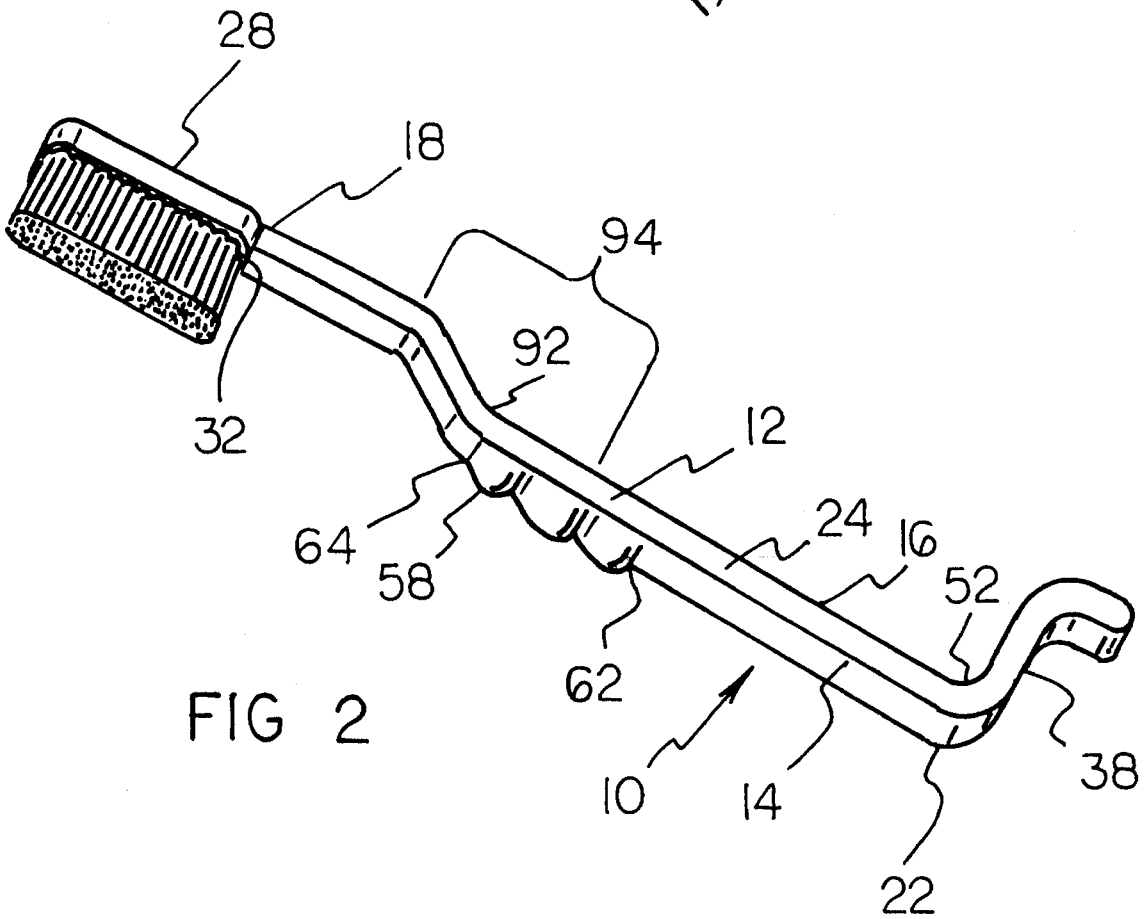
FIG. 2 is an elevational view of the present invention in an operable configuration.
Figure 5:
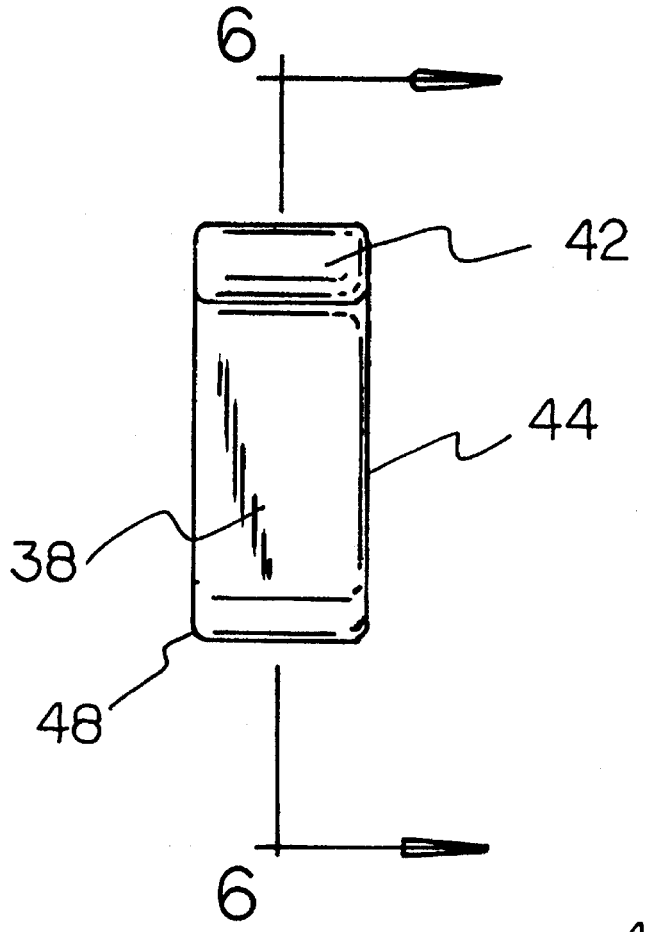
FIG. 5 is a rear view of the proximal end of the present invention.

The distal end 18 of the handle 12 has a generally rectangular head portion 28 adjacent and integral thereto as shown in FIGS. 1 and 2. The head has an upper surface 32 with a plurality of bristle tufts 34 extending therefrom. As best illustrated in FIG. 3, the bristle tufts have a uniform height.

Figure 6:
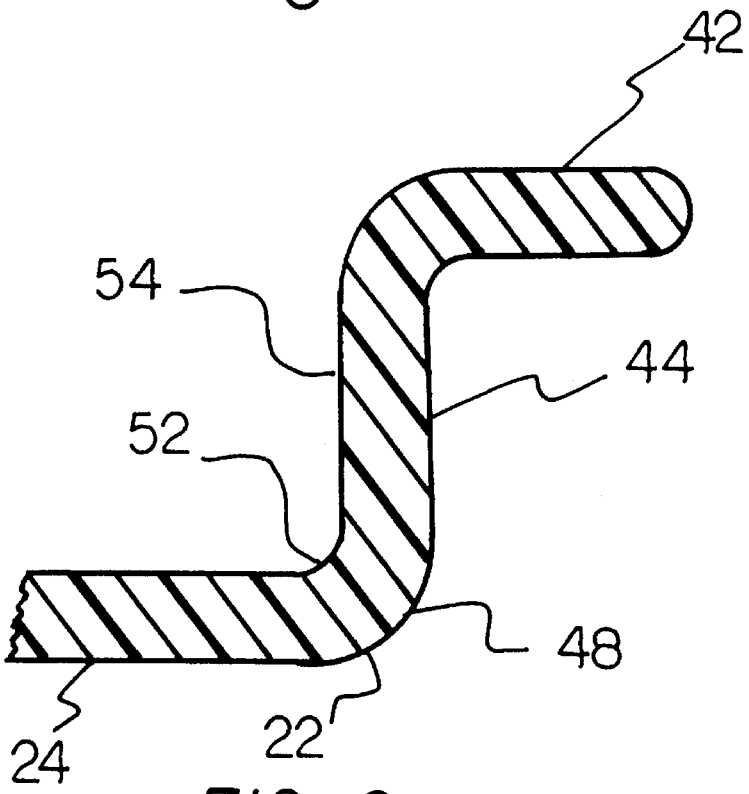
FIG. 6 is a cross-sectional vies of the present invention along lines 6—6 of FIG. 5.

Also included is an L-shaped portion 38 having a horizontal extent 42 in a plane parallel to the intermediate portion of the handle and a vertical extent 44 perpendicular the horizontal extent and the intermediate portion, as shown in FIG. 3. The vertical extent is formed integral with the horizontal extent at a first end 46 and integral with the proximal end of the handle at a second end 48. The L-shaped portion when integral to the proximal end creates a bend 52 at the proximal end of the handle to form a double L-shaped member 54. The double L-shaped member on the handle as shown in FIG. 6 allows the two extents to be mutually orthogonal for comfort with use.

A gripping portion 58 as depicted in FIGS. 2 and 3 is included. The gripping portion has a first end 62 and a second end 64. The first end and the second end are formed on the intermediate portion 24 of the handle 12, and the gripping portion fungilating along the upper surface 14 between the ends, as clearly shown in FIG. 2. The first end is spaced from the proximal end 22. The gripping portion is integral with the handle and undulating for receipt of a thumb 66 of a hand 68 as shown in FIG. 1 to prevent thumb slippage.

Lastly, a distal widened V-shaped portion 72 having a pair of extents 74 and 76 with a distal seat 78 therebetween is provided as shown in FIG. 3. The pair of extends form a second extent 76 that has a second end 84 integral with the distal end 18 of the handle 12, and a first extent 74 with a first end 82 integral with the second end 64 of the gripping portion 58. The second extent distances the head from the distal seat, as shown in FIG. 3, for greater brush length. The greater brush length reduces arm movement during brushing. The first end of the distal V-shaped portion and the second end of the gripping portion form a proximal widened V-shaped portion 88 having a proximal seat 92 integral with the second end of the gripping portion.

The distal V-shaped portion and the proximal V-shaped portion form a double V-shaped member 94 spaced from the distal end of the handle. The double V-shaped member allows an index finger 96 to rest thereon while the lower surface 16 of the handle, along the intermediate portion 24 rest in the palm 100 of the hand. Additionally, a smallest finger 102 rest on the vertical extent of the double L-shaped member 54 at the same moment. The hand positioned on the toothbrush as illustrated in FIG. 1, and is supported by the various parts of the handle. The handle with the double L-shaped member and the double V-shaped member prevents twisting of the handle in the hand.

The present invention is a sure-grip toothbrush that has a handle 12 with a double L-shaped bend 54 at its proximal end 22, and a double widened V-shaped bend 94 spaced from its distal end 18. The toothbrush, with the handle different in form from prior art toothbrushes, does not require the user to squeeze the handle with the fingers. The double L-shaped member and the double widened V-shaped member allow the handle of the toothbrush to rest in the palm of the hand. The double L-shaped member and the double widened V-shaped member allow the handle to be loosely locked in the hand while the thumb is supported by the gripping portion.

Holding the toothbrush as illustrated in FIG. 1 prevents the handle from slipping or moving around in the hand. This new toothbrush is easy to hold, especially by those with arthritic hands or hands suffering from a motor skills disorder. The toothbrush can be made in a variety of sizes so as to be used by children or adults.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved toothbrush comprising, in combination:

a handle formed of a rigid material having an upper surface, a lower surface, a distal end, a proximal end and an elongated intermediate portion therebetween;

the distal end having a generally rectangular head portion adjacent and integral thereto, the head having an upper surface with a plurality of bristle tufts extending therefrom, the bristle tufts having a uniform height;

an L-shaped portion having a horizontal extent in a plane parallel to the intermediate portion of the handle and a vertical extent perpendicular the horizontal extent and the intermediate portion, the vertical extent being formed integral with the horizontal extent at a first end and integral with the proximal end of the handle at a second end, the two extents being mutually orthogonal, the L-shaped portion being integral to the proximal end creating a bend at the proximal end of the handle to form a double L-shaped member on the handle for gripping support and twisting resistance;

a gripping portion having a first end and a second end, the first end and the second end being formed on the intermediate portion of the handle and the gripping portion undulating along the upper surface between the ends, the first end being spaced from the proximal end, the gripping portion being integral with the handle and undulating for receipt of a thumb of a hand; and a distal widened V-shaped portion having a pair of extents with a distal seat therebetween, the V-shaped portion being a portion of the handle and integral the distal end, the pair of extents form a second extent with a second end integral with the distal end of the handle and a first extent with a first end integral with the second end of the gripping portion, the second extent distances the head from the distal seat, the first end of the V-shaped portion and the second end of the gripping portion form a proximal widened V-shaped portion having a proximal seat integral with the second end of the gripping portion, the distal V-shaped portion and the proximal V-shaped portion form a double V-shaped member spaced from the distal end of the handle for allowing an index finger to rest thereon while the lower surface of the handle along the intermediate portion rest in a palm of the hand and a smallest finger rest on the vertical extent of the double L-shaped member to prevent twisting of the handle in the hand.

* * * * *